US010145648B1

(12) United States Patent
Holder et al.

(10) Patent No.: US 10,145,648 B1
(45) Date of Patent: Dec. 4, 2018

(54) ANTI-SLIP HANDGUARD ASSEMBLY

(71) Applicant: Bowden Tactical, LLC, Willoughby, OH (US)

(72) Inventors: Wesley S. Holder, Chardon, OH (US); James W. Wiggins, Rome, OH (US)

(73) Assignee: Bowden Tactical, LLC, Willoughby, OH (US)

( * ) Notice: Subject to any disclaimer, the term of this patent is extended or adjusted under 35 U.S.C. 154(b) by 0 days.

(21) Appl. No.: 15/871,600

(22) Filed: Jan. 15, 2018

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41A 21/48
USPC ..... 42/75.01–75.03, 71.01, 72, 73, 90
See application file for complete search history.

(56) References Cited

U.S. PATENT DOCUMENTS 8,234,808 B2 8/2012 Lewis et al.
8,689,478 B2 4/2014 Patel
8,904,691 B1 * 12/2014 Kincel ..... F41C 23/16 42/71.01
9,157,697 B2 10/2015 Leclair
9,389,043 B1 * 7/2016 Zhang ..... F41C 23/16
9,464,865 B2 10/2016 Shea et al.
9,599,430 B1 3/2017 Geissele
9,683,808 B2 6/2017 Gagnon
9,791,239 B1 * 10/2017 Kincel ..... F41C 23/16
2012/0204465 A1 * 8/2012 Hasler ..... F41A 3/64 42/75.03
2015/0168095 A1 6/2015 Dubreuil
2016/0091276 A1 * 3/2016 Miller ..... F41C 23/16 42/75.02
2017/0097207 A1 4/2017 Hines

* cited by examiner

*Primary Examiner* — Reginald S Tillman, Jr.
(74) *Attorney, Agent, or Firm* — Rankin, Hill & Clark LLP

(57) ABSTRACT

A handguard assembly includes a handguard and a key. The handguard includes a first ear with a first ear inner surface and a second ear with a second ear inner surface that cooperate to define a slot that extends in a longitudinal direction. The key is received in the handguard and includes a main body with an interior side and an exterior side that face in opposite directions from one another so as to define a main body depth and a first projection extending from the interior side of the main body so as to define a first projection depth. The first projection includes a first projection contact face that contacts the second ear inner surface when at least one fastener compresses the slot so as to prevent overtightening of the handguard.

17 Claims, 8 Drawing Sheets

ANTI-SLIP HANDGUARD ASSEMBLY

BACKGROUND

Handguards are utilized on many types of firearms for a variety of reasons. Handguard can provide for an improved grip for the user of the firearm. Further, the handguard also provides protection to the user, by isolating some of the heat that can be generated by a barrel during operation of the firearm. Further still, the handguard can provide for attachment area for one or more accessories, which could include an optical sight, illumination device, or additional weaponry, or other items.

The handguard can be attached to the firearm in a variety of ways. Although the typical methods of connection usually work adequately, installation of the handguard onto the firearm is dependent upon the installer correctly tightening the barrel nut and the fasteners of the handguard assembly. As will be appreciated, this can result in variable outcomes which may not be desired. Thus, a better handguard assembly is needed.

SUMMARY

In view of the foregoing, a handguard assembly is provided that includes a handguard and a key. The handguard includes an interior surface and an exterior surface. The interior surface faces toward an associated barrel of an associated firearm and the exterior surface faces away from the associated barrel. The handguard extends between a breech end of the handguard and a muzzle end of the handguard so as to define a longitudinal direction.

The handguard also includes a first ear with a first ear inner surface and a second ear with a second ear inner surface that cooperate to define a slot that extends in the longitudinal direction. The key is received in the handguard and includes a main body with an interior side and an exterior side that face in opposite directions from one another so as to define a main body depth and a first projection extending from the interior side of the main body so as to define a first projection depth. The first projection includes a first projection contact face that contacts the second ear inner surface when at least one fastener compresses the slot so as to prevent overtightening of the handguard.

According to an aspect, a handguard assembly includes a barrel nut threadably attached to an associated receiver of an associated firearm. The barrel nut defines at least one projection receiving portion circumferentially disposed about an outer diameter of the barrel nut. The handguard assembly also includes a key including a main body that defines a main body depth and a first projection that defines a first projection depth. The first projection is slidably received in the at least one projection receiving portion of the barrel nut.

The handguard assembly also includes a handguard that at least partially surrounds at least part of the barrel nut in a circumferential manner. The handguard defines a key receiving recess that slidably receives the main body of the key and a first projection receiving bore that slidably receives the first projection of the key. The first projection is received in the first projection receiving bore so as to prevent longitudinal movement of the handguard.

DETAILED DESCRIPTION

Figure 1:
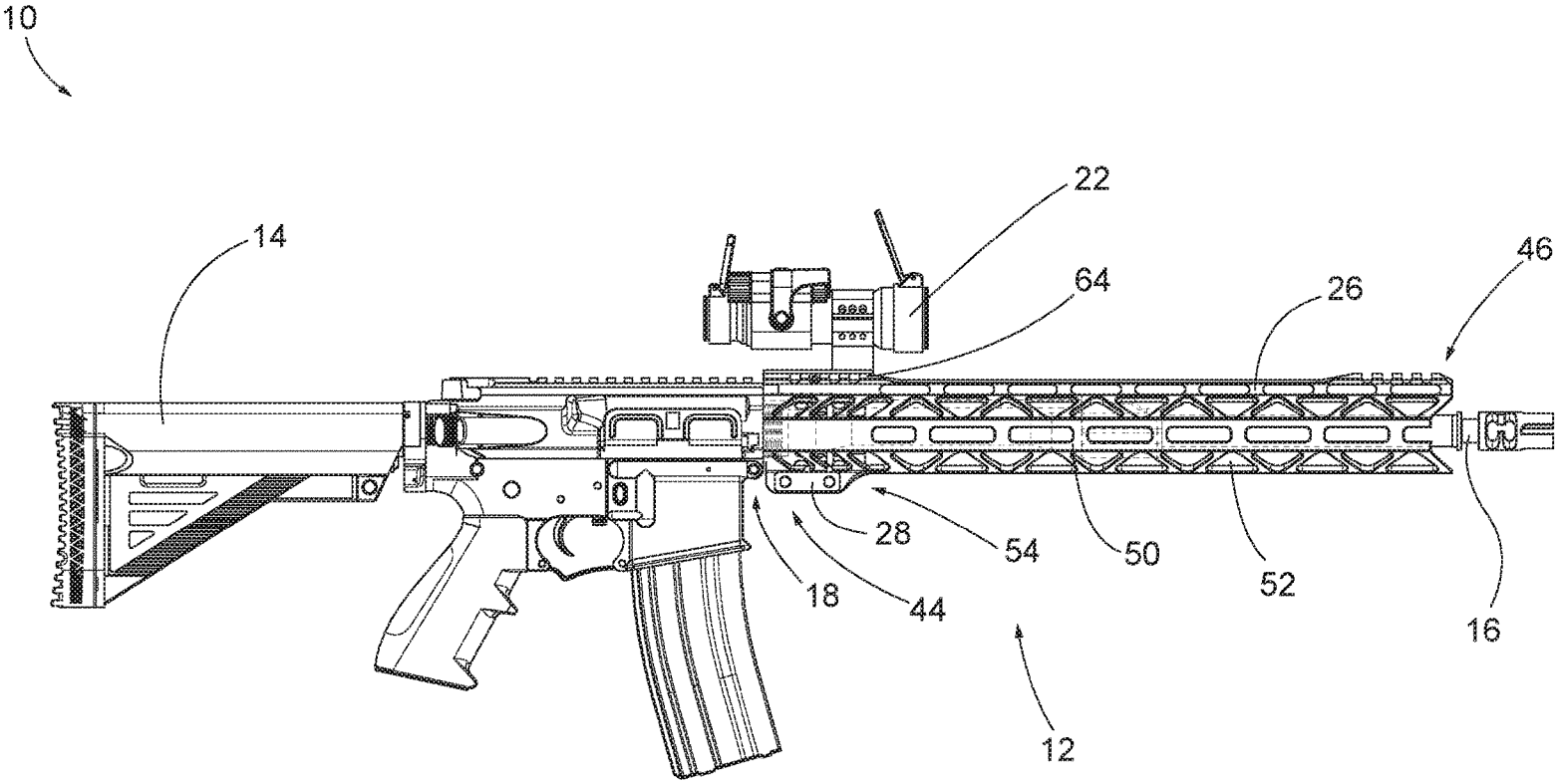
FIG. 1 is an elevation view of a firearm with a handguard assembly.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 schematically depicts a firearm 10 according to the present disclosure.

The term "firearm" is used to denote any type of weapon that discharges projectiles. It will be appreciated that the firearm 10 could be any number of configurations without departing from the scope of this disclosure. As illustrated, the firearm 10 is a semi-automatic rifle that can be magazine fed. The basic operation of the firearm 10 is well understood, and a detailed explanation thereof is not necessary for an understanding of the present invention.

Figure 2:
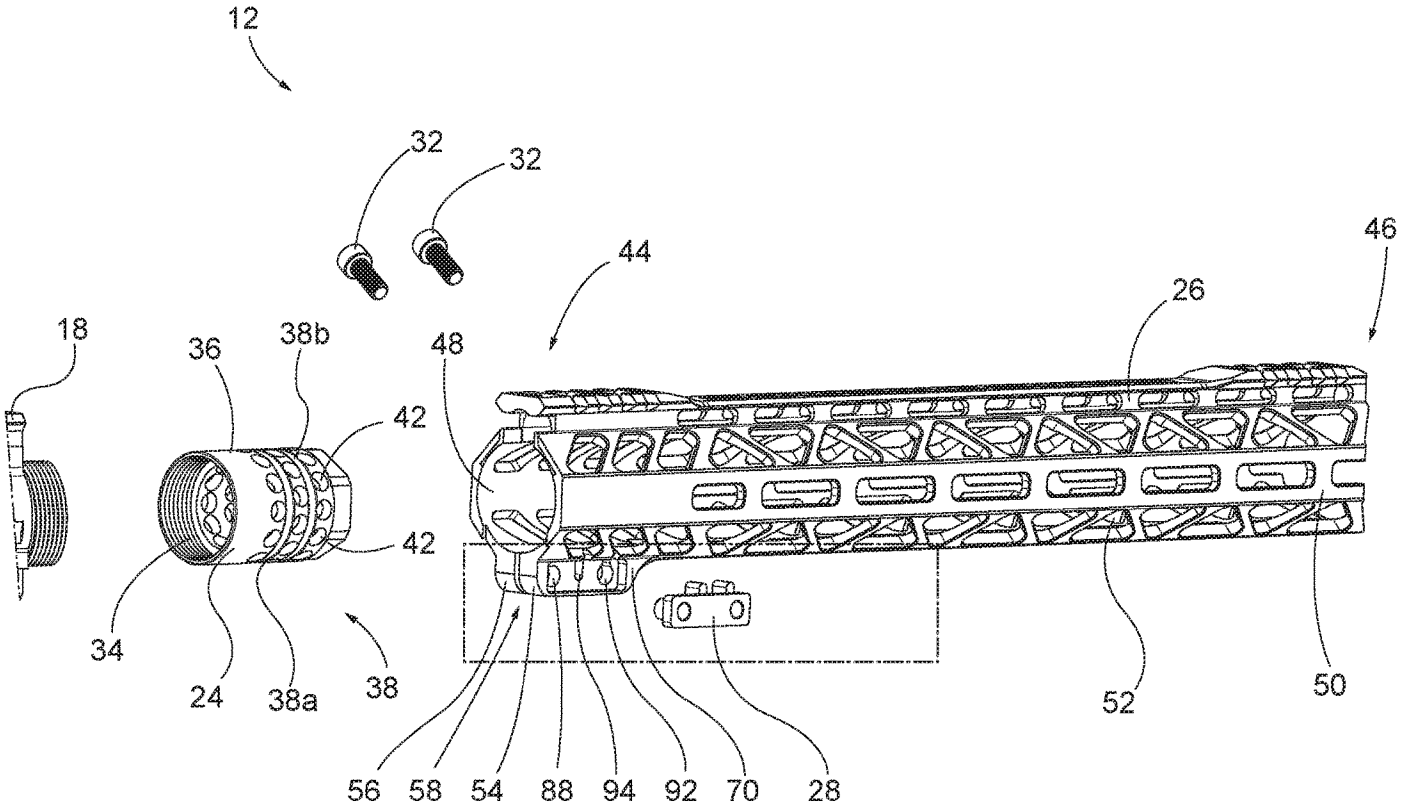
FIG. 2 is an exploded perspective view of the handguard assembly.

The firearm 10 generally includes a handguard assembly 12, a stock 14, a barrel 16, a receiver 18, and an accessory 22. The stock 14 is disposed at a rear end of the firearm and the barrel 16 is disposed at a front end of the firearm 10, with the receiver 18 disposed therebetween. As shown, the accessory 22 is a reflector type sight (e.g., a red dot sight). However, it will be appreciated that any number of other accessories would be possible, including for example a light or other aiming system. With reference to FIG. 2, the handguard assembly 12 is shown in exploded view. The handguard assembly 12 can include a barrel nut 24, a handguard 26, a key 28, and at least one fastener 32.

With continued reference to FIG. 2, the barrel nut 24 is shown. The barrel nut 24 can have a cylindrical outer shape and defines an inner diameter 34 and an outer diameter 36. The inner diameter 34 of the barrel nut 24 allows for passage of the barrel 16 of the firearm 10 and the outer diameter 36 is at least partially received in the handguard 26. The barrel nut 24 may be made from any number of materials without departing from the scope of this disclosure. The barrel nut 24 merely needs to be made of a material of sufficient strength to provide a sturdy interface between the receiver 18 and the handguard 26.

The barrel nut 24 can include at least one projection receiving portion 38. As illustrated, there are a plurality of projection receiving portions 38*a*, 38*b* depicted as a pair of circumferential grooves that are longitudinally spaced from one another to extend about the outer diameter 36 of the barrel nut 24 without entirely extending from the outer diameter 36 to the inner diameter 34. Stated another way, the at least one projection receiving portion 38*a*, 38*b* is circumferentially disposed about the outer diameter 36 of the barrel nut 24. The projection receiving portions 38*a*, 38*b* can receive at least one of a first projection 118 and a second projection 124 as will be described in more detail hereinafter.

The barrel nut 24 can also define at least one barrel nut hole 42 that can radially extend through the barrel nut 24 so as to provide fluid communication between the inner diameter 34 and the outer diameter 36. The at least one barrel nut hole 42 can aid in cooling of the associated firearm 10 during firing and also serves to reduce a weight of the barrel nut 24. As shown in FIG. 2, there can be a plurality of barrel nut holes 42 such that the two projection receiving portions 38*a*, 38*b* separate the barrel nut holes 42 into a plurality of circumferentially extending rows.

Notably, an individual barrel nut hole 42 of one of the rows is not longitudinally aligned with another individual barrel nut hole 42 of immediately adjacent circumferentially extending row. As illustrated, the barrel nut 24 includes interior threads for threaded engagement with the receiver 18 of the firearm 10. Further, at an opposite longitudinal end of the barrel nut 24, there can be a hexagonal shaped portion for engagement with a wrench to aid in tightening of the barrel nut 24 to the receiver 18.

With reference to FIGS. 1-4, the handguard 26 is shown. The handguard 26 can also be made from a plurality of materials without departing from the scope of this disclosure. As illustrated, the handguard 26 extends between a breech end 44 and a muzzle end 46 of the handguard 26 so as to define a longitudinal direction. The handguard 26 also includes an interior surface 48 that faces toward the associated barrel 16 of the firearm 10 and an exterior surface 50 that faces away from the associated barrel 16. The handguard 26 can also include at least one port 52 that can provide fluid communication between the interior surface 48 and the exterior surface 50. The at least one port 52 can serve a number of purposes including, for example, improved airflow over the associated barrel 16 that is within the handguard 26, providing tactile feedback to the user of the firearm 10 for proper hand placement, and also improved slip resistance for the user when handling the firearm 10.

The handguard 26 can also include a first ear 54 and a second ear 56. The first ear 54 can include a first ear inner surface 68 and a first ear outer surface 70 and the second ear 56 can include a second ear inner surface 72. The first ear inner surface 68 and the second ear inner surface 72 cooperate to define a slot 58 that extends in the longitudinal direction. The slot 58 separates the first ear 54 and the second ear 56 from one another and extends from the breech end 44 of the handguard 26 toward the muzzle end 46 of the handguard 26 and ends at a terminus aperture 62.

The terminus aperture 62 may provide for movement of the first ear 54 and the second ear 56 toward and away from one another. The terminus aperture 62 can also act as a stress relief to reduce stress of the material in the immediate area. A lateral width of the terminus aperture 62 is greater than a lateral width of the slot 58. Further, the second ear 56 of the handguard 26 can define a first counterbore 76 and a second counterbore 78 for flush receipt of the fasteners 32 as will be described in more detail hereinafter.

Figure 4:
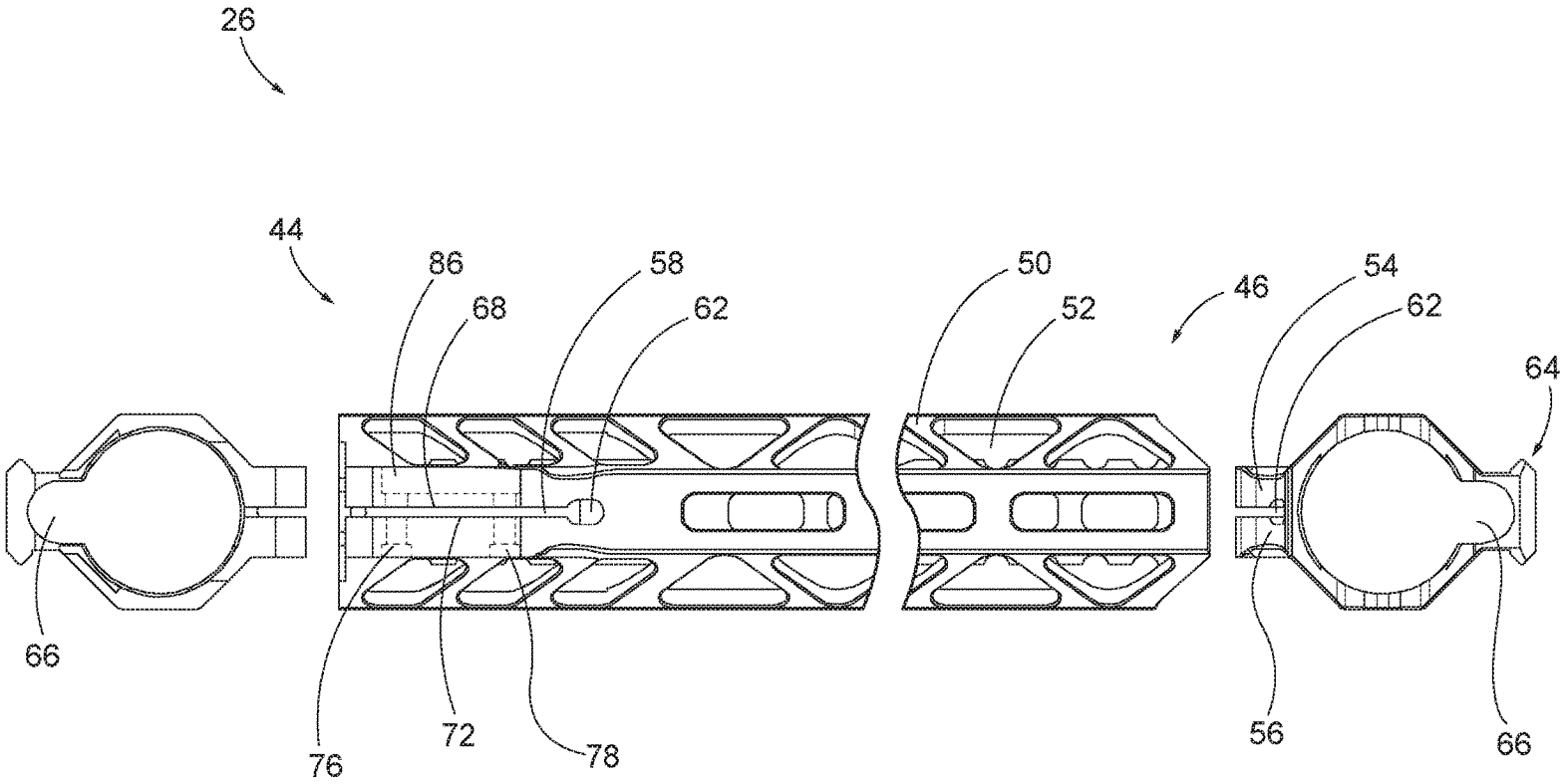
FIG. 4 is a bottom plan interrupted view of a handguard of the handguard assembly.

The handguard 26 can also include a rail mount bracket 64 as shown in FIGS. 1 and 4. The rail mount bracket 64 can be disposed on a top side of the handguard 26 that is vertically opposite the first ear 54 and the second ear 56 such that the associated barrel 16 is disposed vertically therebetween. The rail mount bracket 64 extends primarily in the longitudinal direction and is configured for receipt of the accessory 22. The rail mount bracket 64 may be integral to the handguard 26 and may be of any number of configurations without departing from the scope of this disclosure. For example, it is envisioned that the rail mount bracket 64 could be of a Picatinny rail (also known as MIL-STD-1913 rail or Standardization Agreement 2324 rail) configuration, to act as a standard mounting platform including rails with multiple transverse slots.

Alternatively, and also by way of example, the rail mount bracket 64 could be of a Weaver rail mount configuration. The rail mount bracket 64 can define a tunnel 66 having a tunnel length that extends so as to be generally parallel to the barrel 16 of the firearm 10. Further, the tunnel length is greater than a longitudinal length of the slot 58. The tunnel 66 can provide for a reduced weight of the handguard 26 and also improved cooling of the associated barrel 16. The tunnel 66 can also provide for the movement of a gas piston (not shown) of the associated firearm 10 as will be understood to one of skill in the art.

Figure 3:
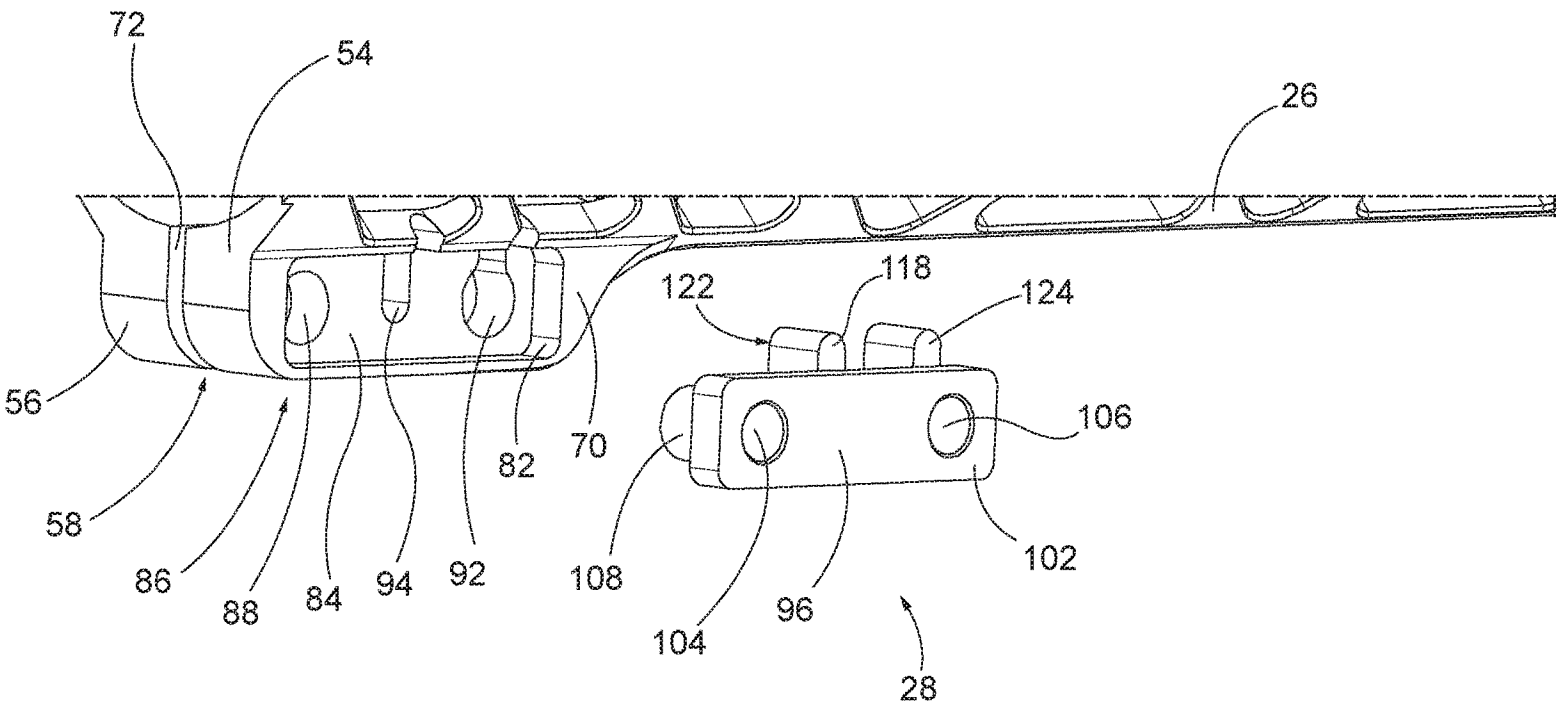
FIG. 3 is an enlarged perspective view of the dashed box of FIG. 2.

With reference to FIGS. 2-3, the handguard 26 can also include a perimeter wall 82 and an exterior face 84. The exterior face 84 faces in a direction opposite the first ear inner surface 68. The perimeter wall 82 and the exterior face 84 of the handguard 26 cooperate to define a key receiving recess 86. The key receiving recess 86 accepts receipt of the key 28 as will be described in more detail hereinafter. Further, the exterior face 84 is offset from the exterior surface 50.

As shown in FIGS. 2-4, the handguard 26 can define a first boss receiving bore 88, a second boss receiving bore 92, and an obround shaped first projection receiving bore 94. As illustrated, the first boss receiving bore 88 has a circular shape, whereas the second boss receiving bore 92 is a combination of circular and obround in shape. The first boss receiving bore 88 and the second boss receiving bore 92 each extend through the exterior face 84 of the key receiving recess 86, the first ear inner surface 68, and the second ear inner surface 72.

The first boss receiving bore 88 and the second boss receiving bore 92 can be coaxially aligned with the first counterbore 76 and the second counterbore 78. A portion of the second boss receiving bore 92 can laterally extend from the exterior surface 50 of the handguard 26 to the first ear inner surface 68 for sliding receipt of portions of the key 28. Further, the first projection receiving bore 94 laterally extends from the exterior surface 50 of the handguard 26 to the first ear inner surface 68 for sliding receipt of portions of the key 28 as will be described in more detail hereinafter.

Figure 5:
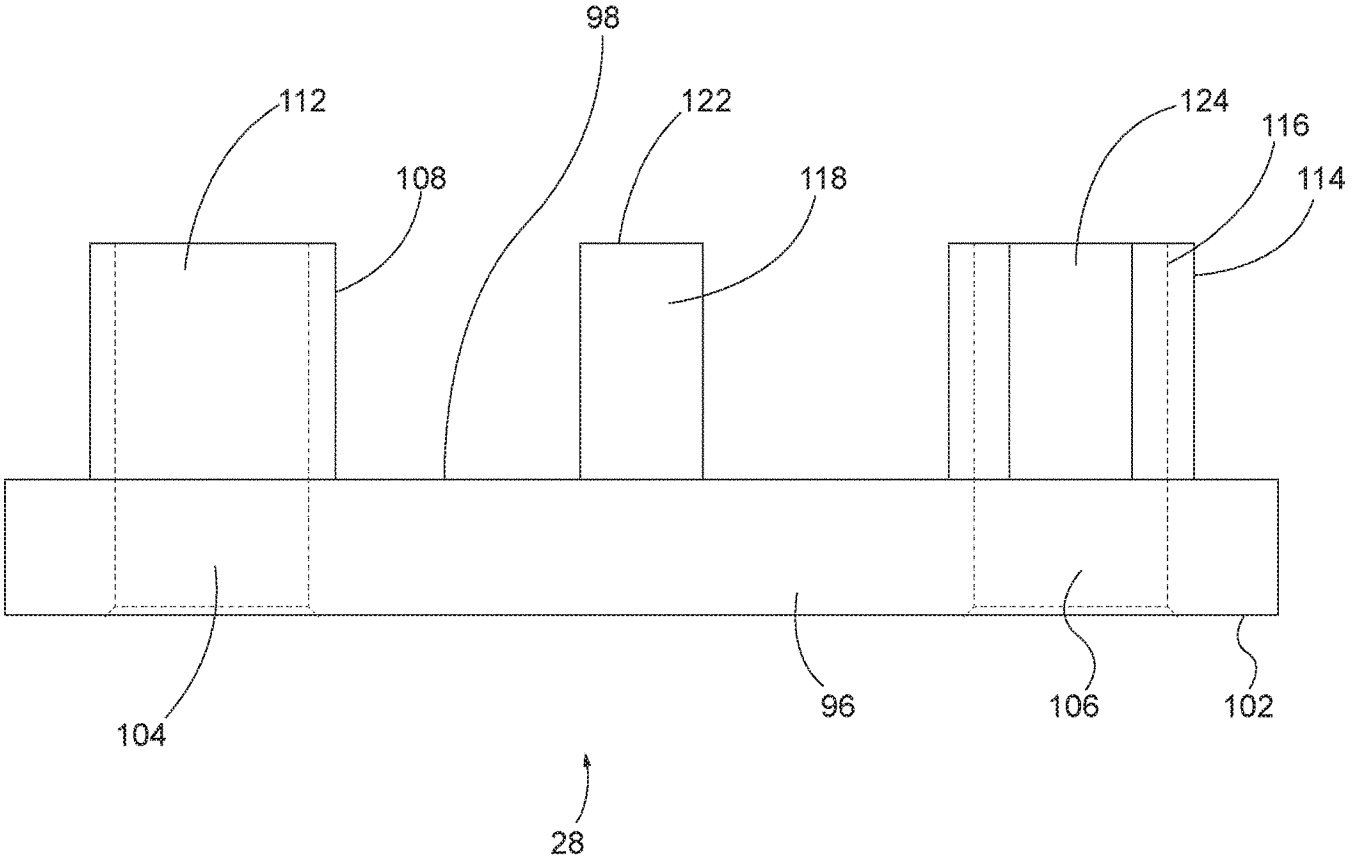
FIG. 5 is a top plan view of a key of the handguard assembly.
Figure 6:
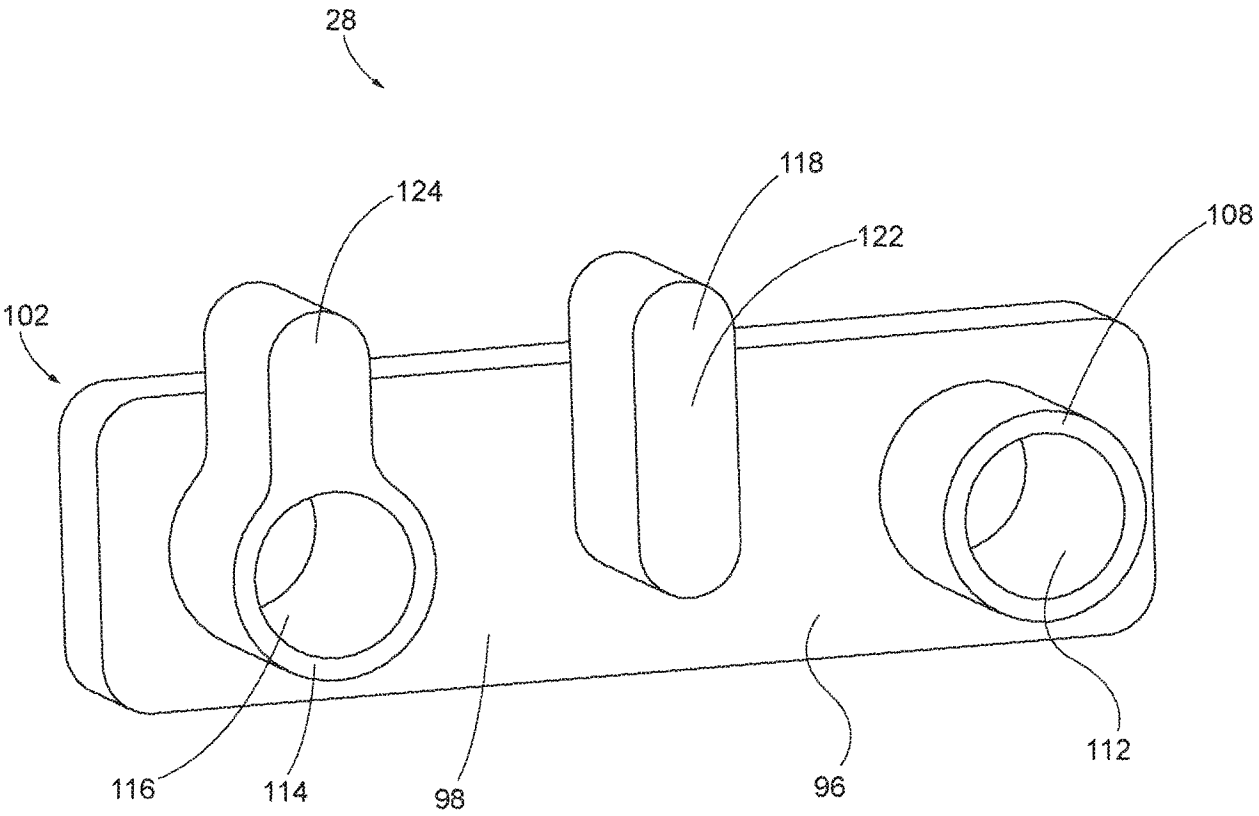
FIG. 6 is a perspective view of the key of the handguard assembly.

With reference to FIGS. 5-6, the key 28 is depicted. The key 28 can be made of similar or different materials than the barrel nut 24 and the handguard 26. The key 28 includes a main body 96 that can have a generally rectangular shape. The main body 96 may include an interior side 98 and an exterior side 102 that face in opposite directions from one another so as to define a main body depth. The main body depth can be equal to the perimeter wall depth such that the exterior side 102 of the key 28 is coplanar with the outer surface 70 of the first ear 54 of the handguard 26 when the key 28 is installed in the handguard 26. Thus, the key receiving recess of the handguard 26 slidably receives the main body 96 of the key 28. This coplanar arrangement provides ease of use for the user of the firearm 10.

The main body 96 can also define a main body first through-hole 104 and a main body second through-hole 106. The key 28 can also include a first boss 108 that defines a first boss hole 112 and a second boss 114 that defines a second boss hole 116. The first boss 108 and the second boss 114 each extend from the interior side 98 of the key 28 in a direction away from the exterior side 102 so as to define a first boss depth and a second boss depth, respectively.

The first boss 108 and the second boss 114 can be coaxially aligned with the main body first through-hole 104 and the main body second through-hole 106, respectively. Further, the first boss receiving bore 88 and the second boss receiving bore 92 can coaxially and slidingly receive the first boss 108 and the second boss 114, respectively. It is noted that by having a first boss 108 and a second boss 114 that stability and engagement of the key 28 is enhanced. However, it is envisioned that the handguard assembly 12 could utilize a single boss and associated members without departing from the scope of this disclosure.

It is also noted that the main body first through-hole 104 and the first boss hole 112 can be threadingly aligned with one another, as can the main body second through-hole 106 and the second boss hole 116 be threadingly aligned with one another. The key 28 can also include a first projection 118 that extends from the interior side 98 of the main body 96 so as to define a first projection depth.

The first projection 118 can include a first projection contact face 122 that contacts the second ear inner surface 72 when the at least one fastener 32 compresses the slot 58. This prevents overtightening of the handguard 26 as will be described in more detail hereinafter. Further, the first projection depth can be equal to the first boss depth and also the second boss depth. Further still, the first projection depth can be greater than the main body depth.

The key 28 can also include a second projection 124. The second projection 124 can extend from the main body 96 so as to be generally parallel to the first projection 118. Further, the second projection 124 can be integral with the second boss 114. Further still, the second projection 124 can define a second projection depth that is equal to the first projection depth. At least one of the projection receiving portions 38*a*, 38*b* of the barrel nut 24 can slidably receive and engage at least one of the first projection 118 and the second projection 124. It is noted that by having a first projection 118 and a second projection 124 that the strength of the handguard assembly 12 is enhanced.

When at least one of the first projection 118 and the second projection 124 engage at least one of the projection receiving portions 38*a*, 38*b* of the barrel nut 24, longitudinal movement between the barrel nut 24 and the key 28, and hence between the handguard 26 and the associated receiver 18 is largely eliminated, thereby improving fit and functionality of the firearm 10. Notably, the first projection 118 is received in the first projection receiving bore 94 so as to prevent longitudinal movement of the handguard 26. It is envisioned that the handguard assembly 12 could utilize a single projection and associated members without departing from the scope of this disclosure.

With reference once again to FIG. 2, the handguard assembly 12 can also include at least one fastener 32. As illustrated, there are a plurality of fasteners 32. The fasteners 32 can be 10-32×½" socket head cap screws. However, it will be understood that any number of fasteners 32 could be utilized without departing from the scope of this disclosure. By utilizing a plurality of fasteners, the connection between the barrel nut 24, the handguard 26, and the key 28 can be ensured.

In view of FIGS. 1-8, installation of the handguard assembly 12 onto the associated firearm 10 will now be described. Initially, a breech end of the barrel 16 can be at least partially inserted into the receiver 18. Then, the barrel nut 24 is slid over the muzzle end of the barrel 16 to the receiver 18 and then can be threaded onto the associated receiver 18 of the firearm 10. The hexagonal shape of a portion of the barrel nut 24 can aid in proper rotational tightening of the barrel nut 24. Next, the handguard 26, being devoid of the key 28, can be installed so as to receive the barrel 16 such that the breech end 44 of the handguard 26 is near the receiver 18 and the muzzle end 46 of the handguard 26 is near the muzzle end of the barrel 16. Thus, the handguard 26 at least partially surrounds at least part of the barrel nut 24 in a circumferential manner. Once the handguard 26 is oriented in this manner, the key 28 may be inserted in the key receiving recess 86 of the handguard 26.

Figure 7:
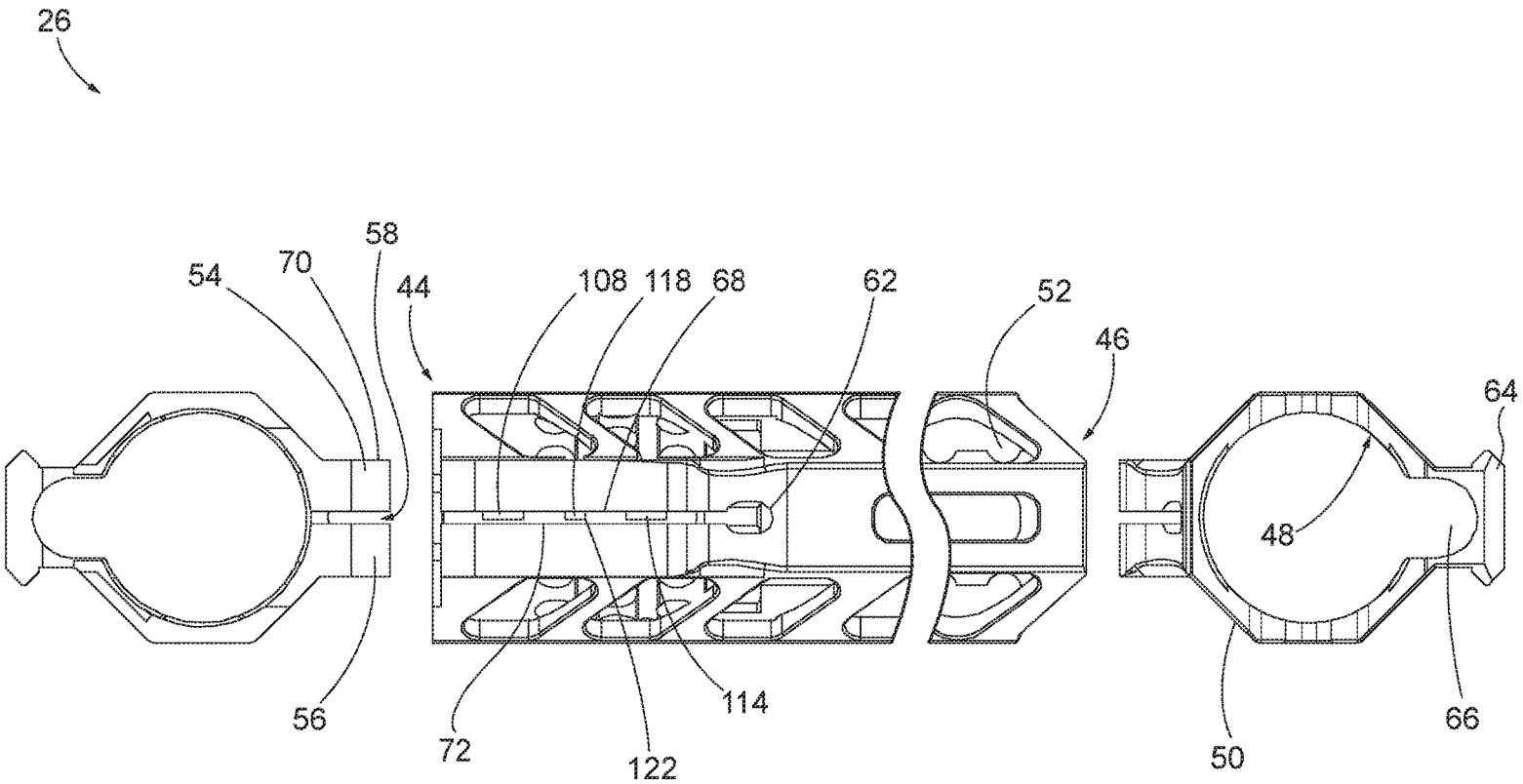
FIG. 7 is a bottom plan interrupted view of the key received by the handguard in an untightened state.
Figure 8:
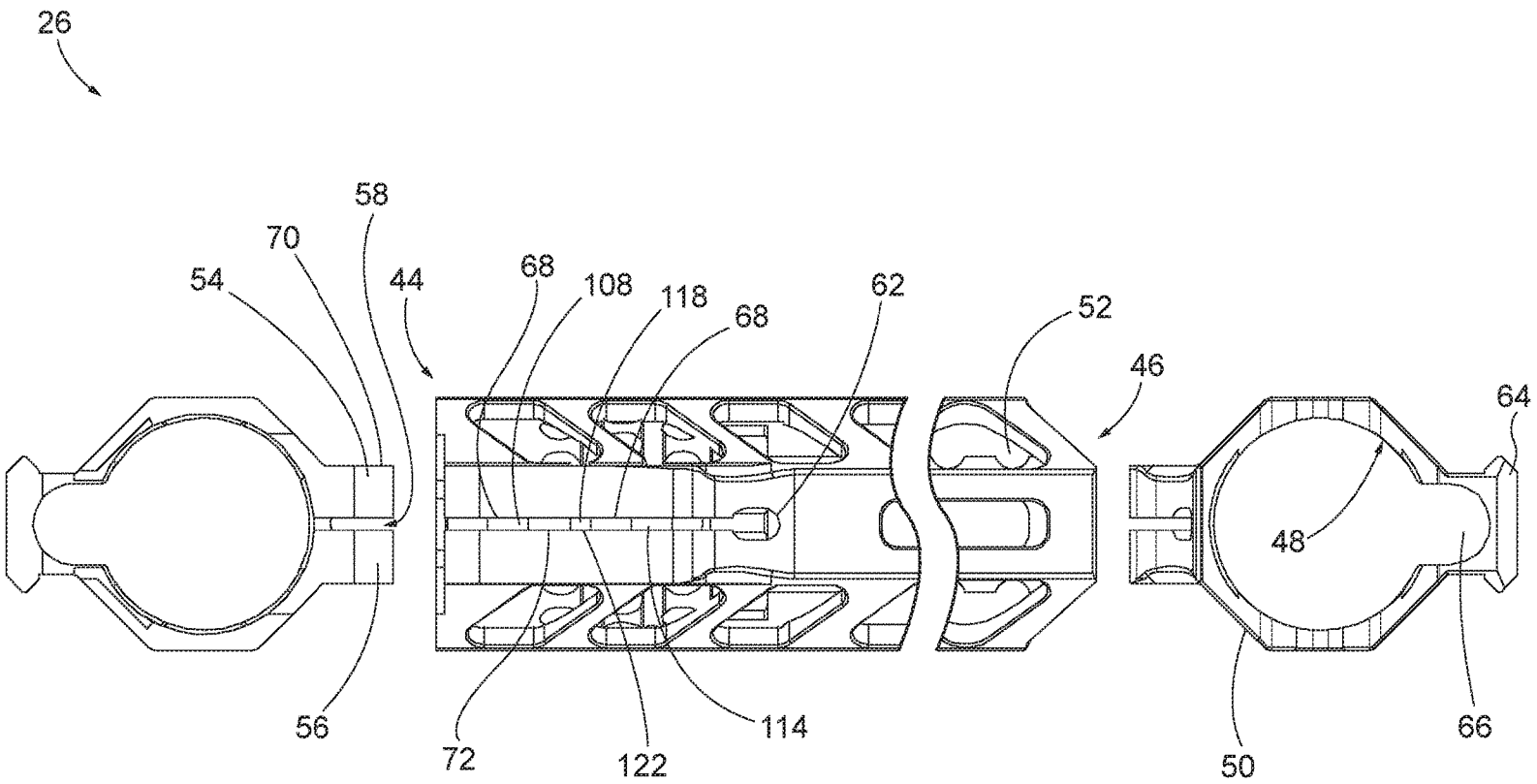
FIG. 8 is a bottom plan interrupted view of the key received by the handguard in a tightened state.

FIG. 7 depicts the key 28 installed into the handguard 26 in an untightened state. Notably, there is a gap between the first projection contact face 122 of the first projection 118 and the second ear inner surface 72 of the second ear 56. Once the key 28 is received in the key receiving recess 86 of the handguard 26, the fastener 32 can be inserted into the counterbores 76, 78 to threadingly engage the first boss hole 112 and the second boss hole 116 and the also the main body first through-hole 104 and the main body second through-hole 106. The fastener 32 can then be tightened until the first projection contact face 122 contacts the second ear inner surface 72 of the second ear 56, as shown in FIG. 8.

When this occurs, the width of the slot 58 (i.e., the lateral distance between the first ear 54 and the second ear 56 decreases), or stated another way, the slot compresses due to the tightness of the fastener 32. This also results in an inner diameter of the handguard 26, thereby providing further engagement with the barrel nut 24. As will be appreciated, this contact between the first projection contact face 122 and the second ear inner surface 72 ensures that the fastener 32 is not overtightened, thereby avoiding a variety of alignment and other fit issues that result when an inner diameter of the handguard is made to be too small by overtightening of the fastener 32.

A handguard assembly has been described above in particularity. Modifications and alternations will occur to those upon reading and understanding the preceding detail description. The invention, however, is not limited to only the embodiment described above. Instead, the invention is broadly defined by the appended claims and the equivalents thereof.

The invention claimed is:

1. A handguard assembly, comprising:

a handguard including an interior surface and an exterior surface, the interior surface facing toward an associated barrel of an associated firearm and the exterior surface facing away from the associated barrel, the handguard extending between a breech end of the handguard and a muzzle end of the handguard so as to define a longitudinal direction, wherein the handguard includes a first ear with a first ear inner surface and a second ear with a second ear inner surface cooperating to define a slot that extends in the longitudinal direction; and a key received in the handguard, the key including a main body with an interior side and an exterior side that face in opposite directions from one another so as to define a main body depth and a first projection extending from the interior side of the main body so as to define a first projection depth; wherein the first projection includes a first projection contact face that contacts the second ear inner surface when at least one fastener compresses the slot so as to prevent overtightening of the handguard.

2. The handguard assembly of claim 1, wherein the key includes a second projection extending from the main body so as to be generally parallel to the first projection.

3. The handguard assembly of claim 2, wherein the first projection is obround shaped.

4. The handguard assembly of claim 1, the main body defining a main body first through-hole and a main body second through-hole, the key including a first boss and a second boss that each extend from the interior side of the main body in a direction away from the exterior side of the main body so as to define a first boss depth and a second boss depth, respectively, wherein the first boss and the second boss define a first boss hole and a second boss hole, respectively, that are coaxially aligned with the main body first through-hole and the main body second through-hole, respectively.

5. The handguard assembly of claim 4, the key including a second projection that is integral with the second boss, wherein the second projection defines a second projection depth that is equal to the first projection depth, and wherein the first boss depth and the second boss depth are each equal to the first projection depth.

6. The handguard assembly of claim 4, wherein the main body first through-hole and the first boss hole are threadingly aligned with one another and the main body second through-hole and the second boss hole are threadingly aligned with one another.

7. The handguard assembly of claim 1, further comprising a barrel nut that is threadingly engaged to an associated receiver of the associated firearm, the barrel nut defining an inner diameter for passage of the associated barrel and an outer diameter for at least partial receipt in the handguard.

8. The handguard assembly of claim 7, the key including a second projection that defines a second projection depth that is equal to the first projection depth, wherein the barrel nut defines at least one projection receiving portion for engagement with at least one of the first projection and the second projection.

9. The handguard assembly of claim 7, wherein the barrel nut defines at least one barrel nut hole that radially extends through the barrel nut so as to provide fluid communication between the inner diameter and the outer diameter, wherein the barrel nut defines a plurality of projection receiving portions circumferentially disposed about the outer diameter of the barrel nut to form a pair of longitudinally spaced grooves and a plurality of barrel nut holes that radially extend through the barrel nut so as to provide fluid communication between the inner diameter and the outer diameter, and wherein the plurality of projection receiving portions separate the plurality of barrel nut holes into a plurality of circumferentially extending rows.

10. The handguard assembly of claim 1, the handguard defining an obround shaped first projection receiving bore that laterally extends from the exterior surface of the handguard to the first ear inner surface of the handguard for receipt of the first projection of the key.

11. The handguard assembly of claim 1, the handguard including a perimeter wall and an exterior face, the exterior face facing in a direction opposite the first ear inner surface of the handguard, wherein the perimeter wall and the exterior face cooperate to define a key receiving recess that receives the key such that the exterior face of the handguard contacts the interior side of the key, and wherein the exterior face is offset from the exterior surface.

12. The handguard assembly of claim 11, the key including a first boss and a second boss that each extend from the interior side of the main body in a direction away from the exterior side, the handguard defining a first boss receiving bore and a second boss receiving bore that each extend through the exterior face of the key receiving recess, the first ear inner surface, and the second ear inner surface, wherein the first boss receiving bore and the second boss receiving bore coaxially receive the first boss and the second boss, respectively.

13. The handguard assembly of claim 12, wherein the first boss receiving bore and the second boss receiving bore slidingly receive the first boss and the second boss, respectively.

14. The handguard assembly of claim 11, wherein the perimeter wall of the key receiving recess defines a perimeter wall depth that is equal to the main body depth such that the exterior side of the key is coplanar with an outer surface of the first ear of the handguard.

15. The handguard assembly of claim 1, the key including a first boss and a second boss that each extend from the interior side of the main body away from the exterior side of the main body, the handguard defining a first boss receiving bore and a second boss receiving bore, wherein the second ear defines a first counterbore and a second counterbore that are coaxially aligned with the first boss receiving bore and the second boss receiving bore, respectively.

16. The handguard assembly of claim 1, the handguard including a rail mount bracket on a top side of the handguard that is disposed on a vertically opposite side of the first ear and the second ear such that the associated barrel is disposed vertically therebetween, wherein the slot that separates the first ear and the second ear from one another extends from the breech end of the handguard toward the muzzle end of the handguard and ends at a terminus aperture, and wherein a lateral width of the terminus aperture is greater than a lateral width of the slot.

17. The handguard assembly of claim 1, the handguard including a rail mount bracket extending primarily in the longitudinal direction that is configured for receipt of at least one of a firearm accessory, wherein the rail mount bracket defines a tunnel having a tunnel length that extends so as to be generally parallel to the associated barrel of the associated firearm, and wherein the tunnel length is greater than a longitudinal length of the slot.

* * * * *